US006319572B1

(12) United States Patent
Howell

(10) Patent No.: US 6,319,572 B1
(45) Date of Patent: Nov. 20, 2001

(54) CURVED DECORATIVE STRUCTURAL MEMBER

(76) Inventor: David Howell, 333 Hook Rd., Katonah, NY (US) 10536

( * ) Notice: Subject to any disclaimer, the term of this patent is extended or adjusted under 35 U.S.C. 154(b) by 0 days.

(21) Appl. No.: 09/624,015

(22) Filed: Jul. 24, 2000

(51) Int. Cl.[7] ..... B44F 1/00

(52) U.S. Cl. ..... 428/34.1; 428/38; 428/67; 428/138

(58) Field of Search ..... 428/34.1, 38, 67, 428/138; 40/582

(56) References Cited

U.S. PATENT DOCUMENTS 2,429,379 * 10/1947 Swain ..... 40/582
5,441,777 8/1995 Howell ..... 428/11

* cited by examiner

*Primary Examiner*—Alexander S. Thomas
(74) *Attorney, Agent, or Firm*—Bernhard P. Molldrem, Jr.

(57) ABSTRACT

A curved decorative structural member, e.g., an architectural panel is formed of an array of marbles or other translucent or transparent beads or spheroids that are sandwiched between curved front and rear apertured grids. There are spacer members fastened to the front and rear grids, and the marbles are held in respective grid openings in the grids. The lateral distance between grid openings, and the width of the land or bar between openings is different between the front and rear grids in response to the curve. The lands in the rear grid are narrower for convex portions and wider for concave portions. The panels may have a single axis of curvature, or may be of a more complex curved shape such as spherical or conic. The spheroids may be arranged in a design, and can produce a dramatic effect when illuminated from behind. An unapertured curved plastic sheet or plate can be used in place of the rear grid member.

19 Claims, 3 Drawing Sheets

CURVED DECORATIVE STRUCTURAL MEMBER

BACKGROUND OF THE INVENTION

This invention relates to decorative structural members, including panels, such as stained glass windows, mosaic walls, and the like, and is more particularly concerned with a novel arrangement of glass beads such as marbles or similar spheroids arranged in a matrix or framework to provide an attractive visual effect. As the term is used here, a decorative structural panel would be understood to mean a marble wall, mosaic panel, or a sturdy member of the type suitable for use in construction or for ornamentation in architecture. An embodiment of the invention is more specifically directed to a curved marble wall or curved decorative structural panel, e.g., for use as a corner or as an S-profile wall, for example. According to other aspects, the curved member can have a more complex curved shape, and can be incorporated into a bowl, vase, lamp shade, or basket, for example.

Stained glass windows and walls are traditionally constructed of colored glass sections that are joined together to one another by lead strips. These stained glass constructions consume a large quantity of skilled labor and expensive colored glass to construct, and it is difficult to effect repairs if any of the glass breaks. Other panels, such as those constructed of transparent or translucent colored plastic, have to be constructed in large quantities to obtain manufacturing economies. Further, if these plastic panels are needed as structural architectural panels, e.g., for outdoor use or as part of a wall, they require significant modifications to make them sufficiently durable and rigid.

The term "structural panel" generally applies to building panels that are suitable for use as a component of a building structure, such as a wall formed of marbles. Structural panels and structural wall panels are designed to maintain their structural integrity in use as a building wall or similar structure, and to have rugged features such as ability to withstand wind and weather, cleaning, and handling. Decorative structural panels and architectural panels are intended to be used, for example, where a builder or building contractor would otherwise incorporate into the building a stained-glass window, sand-blasted plate glass, mosaic wall, or other architectural ornamentation. The panels should also be able to be installed like plate glass as a building wall or as a part of the building. The structural architectural panels of this invention can be made as custom architectural panels that are considerably less expensive than traditional stained glass, and can be considered as "contemporary stained glass windows."

A flat screen or panel of this general type, in which an array of colored marbles are sandwiched between front and back apertured grids, is described in my earlier U.S. Pat. No. 5,441,777, the contents of which are incorporated by reference herein.

To date, no practical means have been proposed for constructing a marble wall or other similar transparent or translucent structural panel that is curved about some axis so as to have a finite radius of curvature. That is, no marble wall or the like has been constructed as a corner piece in which the shape curves gently around a corner. It is not possible simply to bend a flat marble wall into a cylindrical shape or a shape having a C- or S-shaped profile. Similarly, no complex curved shape has been accomplished using an array of marbles sandwiched between front and back apertured grids, such as a spherical shape (i.e., dome), or a conic shape.

OBJECTS AND SUMMARY OF THE INVENTION

It is an object of this invention to provide a structural member that achieves a visual effect that was not possible in the prior art.

It is a more specific object of this invention to structural or architectural panel or member which incorporates transparent or translucent elements that play on the aesthetic effects of light in the environment.

It is a more particular object to provide a curved structural panel that carries the visual effect of the panel continuously around a curve about at least one axis of curvature.

In accordance with an aspect of the present invention, a curved decorative structural member, such as a panel is constructed of an array of bead members (e.g., glass marbles) that are sandwiched between front and rear grids. The front and rear grids have openings in register with the corresponding openings of the other grid and retain respective ones of the bead members. Spacer members are situated between the front and rear grids to hold the grids in position. The spacer members each have a predetermined length to define a spacing distance between the grids so to accommodate the bead members. The front and rear grids are each curved about an axis of curvature, such that there is a first radius of curvature for the front grid and a second radius of curvature for the rear grid. The spacer members generally define the difference between the first and second radii of curvature. The geometry of the grids is such that respective separations between the openings in each of said front and rear grids vary relative one to the other in an inverse relation with radius of curvature. This keeps the bead members, e. g., marbles, in the proper relationship to one another over the curved portions of the panel. There can be more than one axis of curvature, e.g., for an S-shaped profile, and these can be changing axes of curvature, or axes of curvature in different planes, if it is desired to create a more complex curved shape, such as spheric, ovoid, toroidal, or conic.

In a preferred embodiment, the marbles or glass spheroids are translucent and of assorted colors, and are arranged in a representational or non-representational design in the manner of a mosaic. This can be illuminated from the back side for a dramatic effect.

The grid openings can be rectangular, either square or oblong, circular, or a polygonal shape, such as a pentagon, a hexagon or an octagon. In a preferred embodiment there are corresponding lands situated between successive openings in each of the front and rear grids, and the widths of the lands are selected to align the grid openings with respect to the curve. For a given axis of curvature, these lands for the front and rear grids have widths in an approximate ratio of $(1+s/r_1)$ where s is the spacing distance of the spacer member and $r_1$ is the radius of curvature for the front grid.

The spacer members can include a tubular member having a bore to accept a threaded fastener. The threaded fastener can be a screw or bolt that passes through the spacer member and receives a nut, or can itself be threaded to receive screws through each of the grids.

In other embodiments, the decorative structural panel can take the shape of a cone or a portion of a cone, in which case there are outer and inner conic grids, with spacer elements and an array of glass spheroids sandwiched between the outer and inner grids. The outer and inner grids can have the same axis, and may have the same or different conic angles.

The grid members are favorably sheets of aluminum, brass, steel, or another durable metal. However, the invention is not limited to metal grids, and grids made of other materials, for example, plastics, could be employed.

The above and many other objects, features, and advantages of this invention will become apparent from the ensuing description of several preferred embodiments, which should be read in conjunction with the accompanying Drawing.

DETAILED DESCRIPTION OF THE PREFERRED EMBODIMENTS

Figure 1:
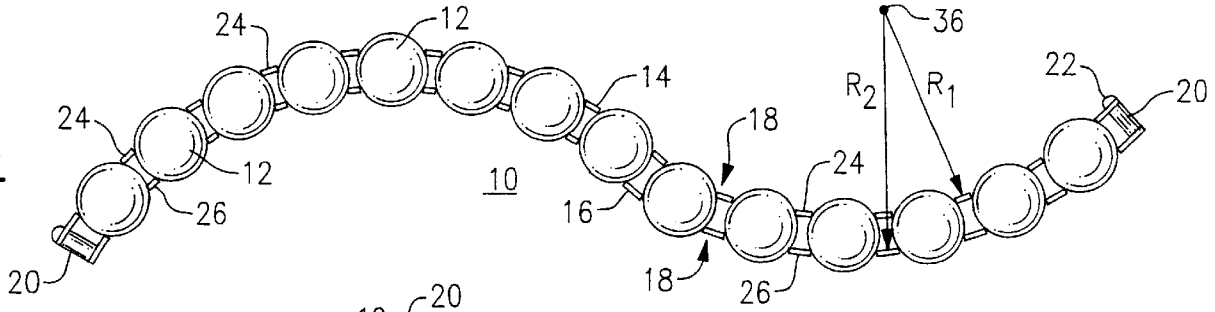
FIG. 1 is a top schematic view showing the profile of a curved decorative structural or architectural panel according to this invention.
Figure 2:
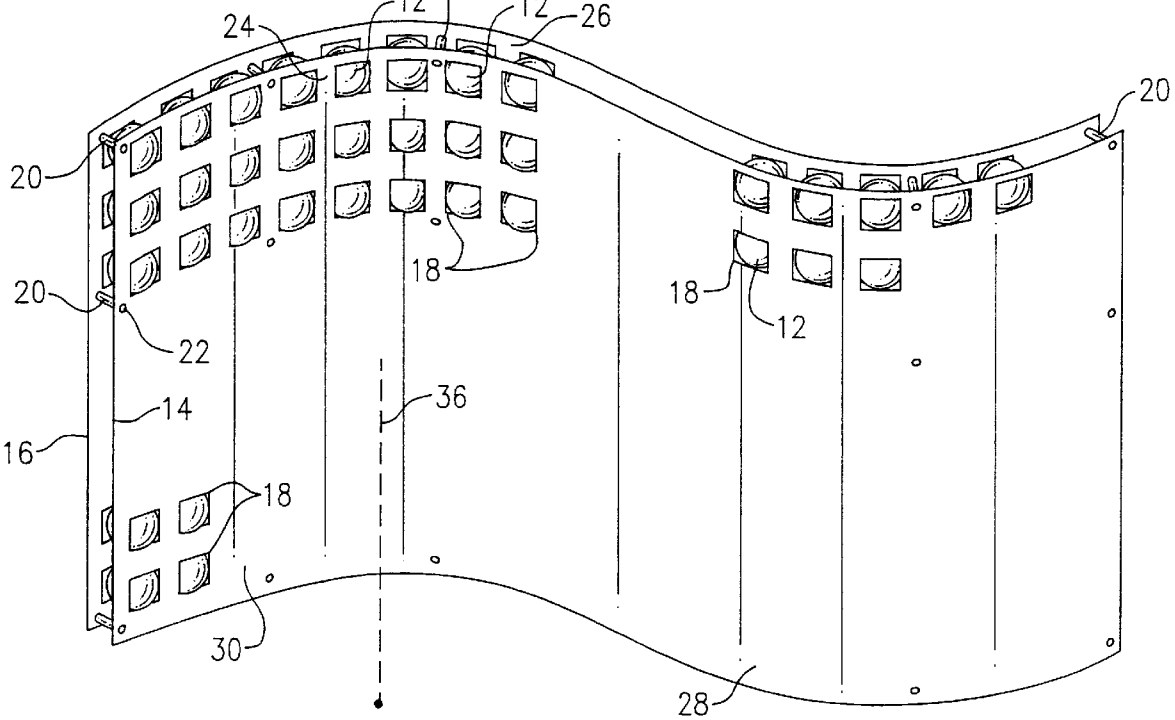
FIG. 2 is a front perspective view of a curved marble wall according to one embodiment of this invention.

FIGS. 1 and 2 illustrate one possible embodiment of a decorative structural panel of this invention and is offered as one example out of many possible variations of the structural member of this invention. The panel need not be of any specific size or shape, but can be suited to a desired architectural or construction purpose.

FIGS. 1 and 2 show a curved panel 10 that is formed of an array of glass marbles 12 or equivalent spheroids that are disposed between a curved front grid member 14 and a curved rear grid member 16. In some embodiments, the marbles can be of a uniform color, but in other embodiments these can be selected of different colors and positioned in the grids 14, 16 to create a representational work, i.e., a picture, or a non-representational, i.e., abstract, arrangement. The spheroids or marbles 12 can be translucent or transparent, and these terms each mean that light passes through it. Consequently, the terms translucent and transparent may be used here interchangeably. In some preferred embodiments, the marbles can be about ⅝ inch (16 mm) in diameter. Each of the front and rear grid members 14, 16 has grid openings 18, which here are square apertures. Other shapes of holes can be used for the openings 18, as will be discussed below. Spacers 20 are positioned between the front and rear grid members, and are held in place by threaded fasteners, i.e., screws 22. The spacers 20 create a predetermined spacing or standoff distance S between the front and rear grid members to accommodate the marbles 12. In this embodiment, a stiff, sturdy sheet steel is used for the front and rear grid members. Other suitable materials could be used, if desired, to create a structural wall that is both pleasing in appearance and able to withstand weather, handling, cleaning, and the like.

In creating a panel 10 with curves, as shown here, it is necessary to change the spacing between openings 18 in one grid member or the other to respond to the curve. In the front grid member 14 of this embodiment there are bars, or lands 24 between successive grid openings and in the rear grid member 16 there are corresponding lands 26 between its grid openings, and these lands each have a width that defines the lateral spacing between marbles in the panel 10. In order to allow the grid members 14, 16 and the marbles or spheroids 12 to bend smoothly around the curves, the lands 24, 26 have their widths selected so that the width of the rear grid member lands 26 is wider than the corresponding front grid member lands 24 for a concave portion 30 of the panel 10, and the rear grid member lands 26 are narrower than the corresponding front grid members lands 24 for a convex portion 28. In this embodiment, the lands on the front grid member 14 are of constant width over the horizontal length of the panel 10, but the lands 28 on the rear grid member vary from narrower where the panel 10 is convex to broader when the panel 10 is concave.

Figure 3:
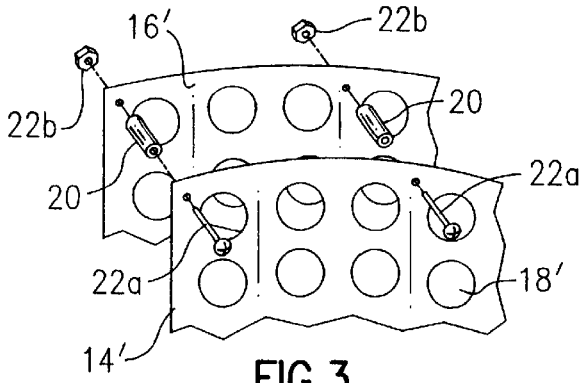
FIGS. 3 and 4 are portions of curved structural panels of this invention showing alternative grid openings.
Figure 4:
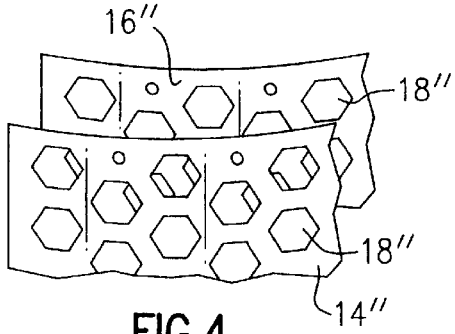

As mentioned before, the grid openings 18 are not limited to square openings, but can be rectangular or other shapes. As shown in FIG. 3, a curved panel 10' can be formed of curved front and rear grid members 14', 16' with round grid openings 18'. As shown in FIG. 4, another curved panel 10" can have front and rear grid members 14", 16" with polygonal grid openings 18", here hexagonal. Other shapes could be employed as well, such as pentagonal or octagonal. As shown also in FIG. 3, the spacer 20' can include a tubular post with a threaded fastener 22' system including a screw member **22*a* that passes through openings in the front and rear grid members and also through the tubular post, and a nut 22*b* that fits the threaded screw member 22*a* behind the rear grid member. Alternatively, the spacer 20 can be a female threaded post and the threaded fastener 22** can be comprised of a pair of male threaded screws.

The structural panel 10 of FIG. 2 can be considered to have a generally vertical axis of curvature 36 positioned in front of the concave portion 30. Similarly, there would be another axis of curvature (not shown) to the right and behind the convex portion 28. At the concave curve, there is a radius $R_1$ of curvature to the front grid member 14 and a longer radius of curvature $R_2$ to the rear grid member 16. The difference between these two radii is the spacing S formed by the spacers 20, i.e., $R_2=R_1+S$. The center-to-center lateral spacing between grid openings 18, and hence, the relative widths of the lands 24 and 26 between the grid openings in the two grid members depends on the ratio of the two radii, $R_2/R_1$, which is $(R_1+S)/R_1$, or simply $(1+S/R_1)$. Of course, for a convex curve, the values of $R_1$ and $R_2$ would be considered as negative values. In other words, the grid opening spacing and land widths vary approximately in relation to the inverse of the radius of curvature. The holes or openings for the spacer fasteners 22 can be placed on mid-portions of corresponding lands 24, 26 of the front and rear grid members.

Figure 5:
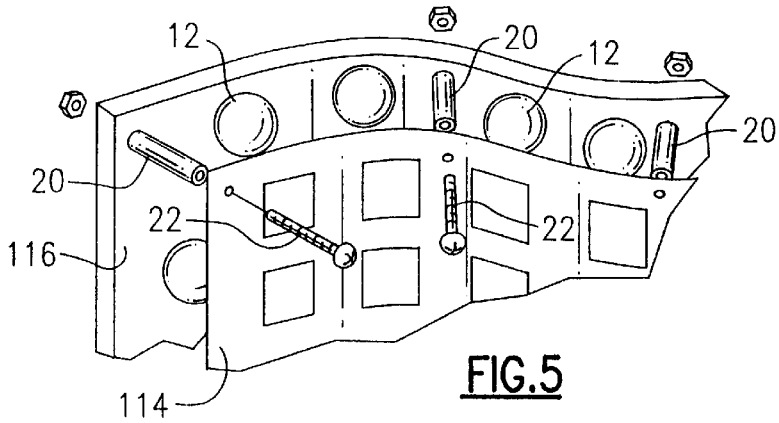
FIG. 5 is a perspective view of a portion of another embodiment.

In other possible embodiments there could be an apertured grid member only on the front side, with a clear plastic sheet positioned behind the glass spheroids. The only holes needed to be present in the clear plastic sheet would be holes for attaching the spacers. These would be positioned to follow the desired curvature. FIG. 5 illustrates an example of this embodiment, with a curved apertured front grid member 114, a curved, unapertured transparent plastic plate 116, glass marbles 12, and spacers 20 with spacer fasteners 22. The rear curved plastic plate 116 may be clear, or may be colored, and may be diffusing or non-diffusing, i.e., cloudy, as desired.

The decorative architectural structural members of this invention, such as panels, are not limited to simple curves about only one axis at time, but can be formed in more complex curved shapes. A spherical shape is possible, for example, which can be in the form of a dome. Also, an ovoid or egg-shaped structure is possible. An example of a conic structural member 40 is illustrated here in FIG. 6, with additional reference to FIGS. 7 and 8.

Figure 6:
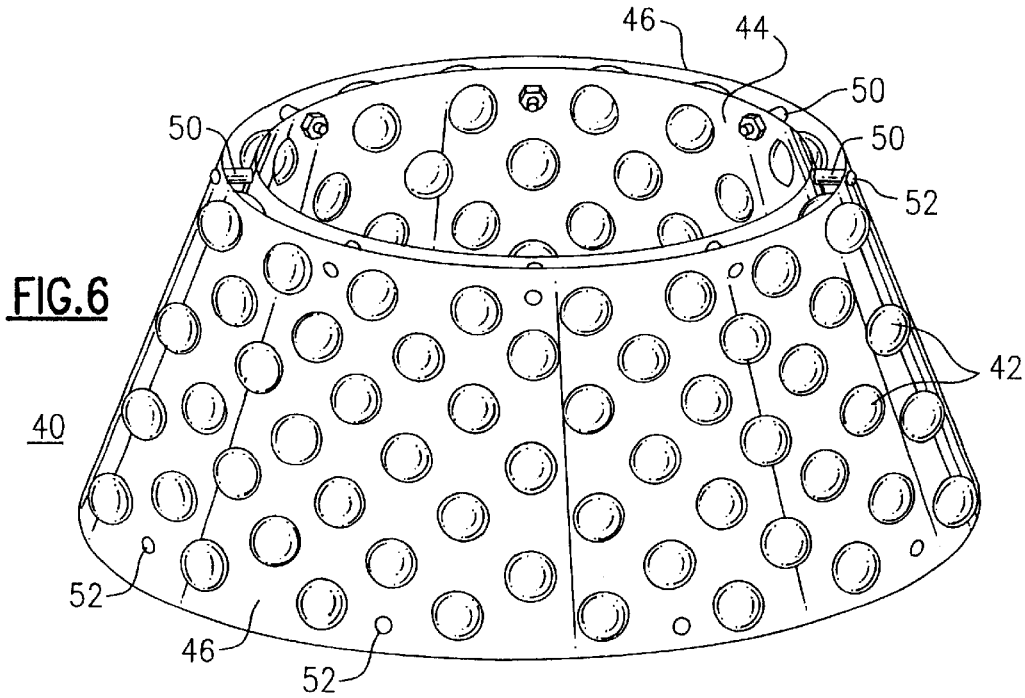
FIG. 6 is a perspective view of a cone-shaped structural panel according to an embodiment of this invention.

As shown in FIG. 6, the conic member 40 has an array of marbles 42 or similar transparent or translucent spheroids sandwiched between an inner conic grid member 44 and an outer conic grid member 46. The outer and inner grid members 44, 46 have corresponding grid openings 48 (here, circular openings) to accommodate the spheroids, and there are spacers 50 that hold the inner and outer grid members together and define a predetermined conic annulus between them for the marbles or spheroids 42. In this embodiment, the two conic grid members 44, 46 are coaxial and have the same cone angle, although other arrangements are possible.

Figure 7:
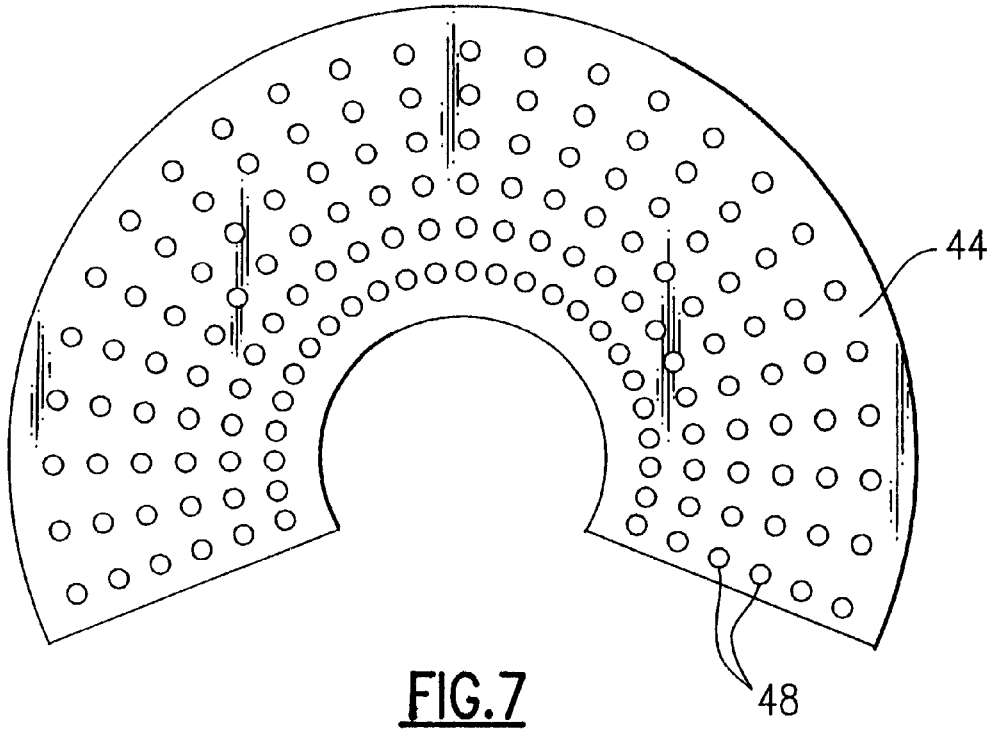
FIGS. 7 and 8 illustrate possible inner and outer grids for the embodiment of FIG. 5.
Figure 8:
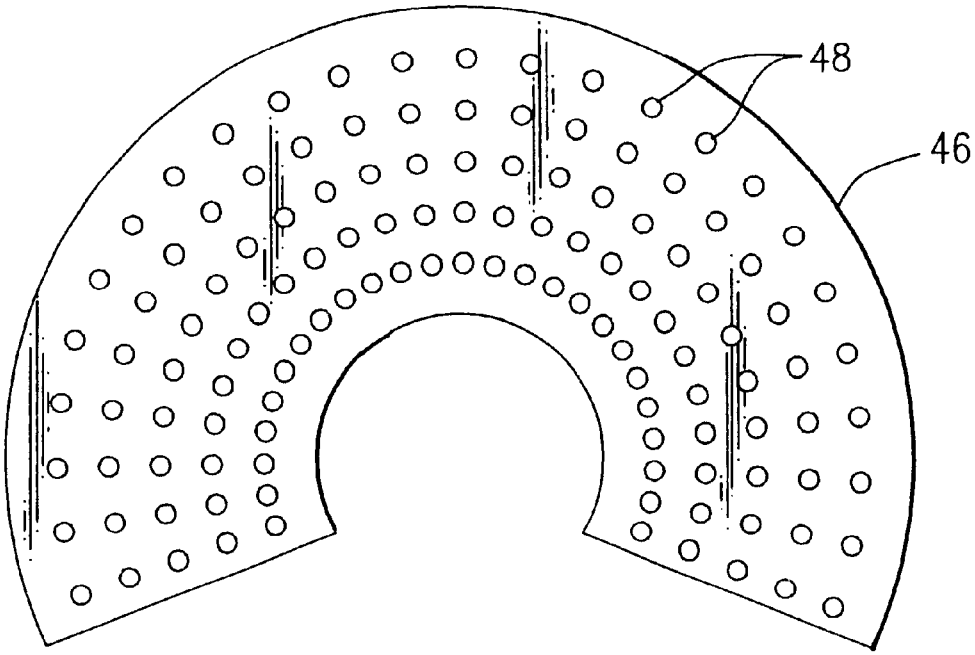

The inner and outer grid members 44 and 46 can be formed first as flat discs with sectors taken out, as illustrated in FIGS. 7 and 8, respectively. The corresponding grid openings 48 would be located in similar locations in each grid member, with the spacings adjusted in proportion to the relative sizes of the two grid members. Then the flat grids can be bent or bowed into the conic shape, and the spheroids or marbles installed between them, and the spacers attached. In this embodiment, the spacers 50 are all the same size and the marbles or spheroids are also of uniform size. However, it is possible to create a decorative structural conic member with larger marbles at the base, for instance, and smaller ones at the top, with the dimensions of the grid members and spacers with different sizes to accommodate that. Also, similar to the embodiment of FIG. 5, a clear plastic conic member without apertures may be used in place of the apertured grid member 44. This is also possible for other curved shapes, such as bowls, domes, or vases.

In any of the foregoing embodiments, and in other possible embodiments, the marbles or spheroids can be selected as to color and transmissivity so that the array creates a desired visual effect. The array of glass spheroids may constitute a picture, i.e., a visual representation or image, or may present an abstract visual effect. Some of the glass spheroids may be clear, and some may be opaque. Multicolored elements, such as cats-eye or tiger-eye marbles may be employed if desired for a dramatic effect, especially if back-lit with either natural or artificial light.

While not shown, the edges of the panels 10, 40 can be finished, for example, either by bending the metal sheet to form a flange, or by installing a frame member along the edge between the front and rear grid members, or between the inner and outer grid members. The flange or frame can be made to follow the curve of the panel.

While the present invention has been described in detail in respect to a few selected preferred embodiments, the invention is not limited to those embodiments. Rather, many modifications and variations are possible without departure from the scope and spirit of this invention, as defined in the appended Claims.

I claim:

1. A curved decorative member in which an array of bead members are sandwiched between front and rear grids, and in which the front and rear grids have openings in register with the corresponding openings of the other grid and which retain respective ones of said bead members therein; and spacer members situated between the front and rear grids which hold said grids in position and which each have a predetermined length to define a spacing distance between the grids to accommodate said bead members; said front and rear grids being curved about at least one axis such that there is a first radius of curvature for the front grid and a second radius of curvature for the rear grid with said spacer members defining a difference between said first and second radii of curvature; and with respective distances between the openings in each of said front and rear grids, with the respective distances in the front and rear grids varying relative one to the other in inverse relation with said radii of curvature.

2. The curved decorative member of claim 1 wherein said bead members include glass spheroids.

3. The curved decorative member of claim 2 wherein said glass spheroids include translucent glass spheroids of assorted colors.

4. The curved decorative member of claim 1 wherein said openings are generally rectangular.

5. The curved decorative member of claim 1 wherein said openings are generally circular.

6. The curved decorative member of claim 1 wherein said openings are polygonal.

7. The curved decorative member of claim 1 wherein each said spacer member is mechanically attached to said front and rear grids at a position between respective openings in said grids.

8. The curved decorative member of claim 1 wherein there are corresponding lands situated between successive openings in said front and rear grids such that center-to-center distances between grid openings are generally in a ratio of $(1+s/r_1)$ where s is the spacing distance of the spacer member and $r_1$ is the radius of curvature for the first grid.

9. The curved decorative member of claim 1 wherein said spacer members each include a tubular member having a bore to accept a threaded fastener.

10. The curved decorative member of claim 1, wherein said member is a structural architectural panel.

11. A curved decorative member in which an array of bead members are sandwiched between an apertured front grid and a rear transparent curved plate and in which the bead members are retained in grid openings in the grid member; and spacer members situated between the front grid and the rear curved plate which hold the same in position and which each have a predetermined length to define a spacing distance between the front grid and rear plate; said front grid and rear plate being curved about at least one axis such that there is a first radius of curvature for the front grid and a second radius of curvature for the rear plate with said spacer members defining a difference between said first and second radii of curvature.

12. The curved decorative member of claim 11 wherein said spacer members are mechanically attached through fastener apertures in said front grid and said rear plate.

13. The curved decorative member of claim 11 wherein said rear plate is provided without apertures for said bead members.

14. The curved decorative member of claim 11 wherein said bead members include translucent spheroids of assorted colors.

15. A curved decorative structural arrangement in the form of a portion of a cone in which an array of bead members are sandwiched between an inner generally conic grid and an outer generally conic grid; said grids each having openings in register with corresponding openings of the other grid to retain respective ones of said bead members therein; and spacer members situated between said inner and outer conic grids defining a generally conic space between them to accommodate said bead members; with the openings in said outer grid having lands therebetween that are wider than corresponding lands between respective ones of the inner conic grid.

16. A curved decorative structural assembly according to claim 15 wherein said spacer members include a tubular spacer having a bore to accept a threaded fastener.

17. A curved decorative structural assembly according to claim 15 wherein said bead members include glass spheroids.

18. A curved decorative structural assembly according to claim 17 wherein said glass spheroids include translucent spheroids of assorted colors.

19. A curved decorative structural assembly according to claim 15 wherein said inner and outer conic grids have substantially the same cone angle.

* * * * *